United States Patent [19]

Burke

[11] 4,162,659

[45] Jul. 31, 1979

[54] BOOKMARK

[76] Inventor: Richard M. Burke, Rte. 163, R.D. #3, Fort Plain, N.Y. 13339

[21] Appl. No.: 952,472

[22] Filed: Oct. 18, 1978

[51] Int. Cl.[2] ..... B42D 9/00

[52] U.S. Cl. ..... 116/234; 281/42

[58] Field of Search ..... 116/119, 234, 235; 281/42

[56] References Cited

U.S. PATENT DOCUMENTS

| | | | |
|---|---|---|---|
| 1,958,831 | 5/1934 | Lorenz | 116/119 |
| 1,977,931 | 10/1934 | Woodley | 116/119 |
| 2,260,415 | 10/1941 | Von Alvensleben | 116/119 |
| 2,630,777 | 3/1953 | Johnson | 116/119 |
| 3,055,680 | 9/1962 | Stoffel | 281/42 |
| 3,381,654 | 5/1968 | Hupp et al. | 116/119 |

*Primary Examiner*—Daniel M. Yasich

[57] ABSTRACT

The object of the invention is to provide a bookmark (1) to underline and indicate a line or passage on a page selected by the reader, to maintain the bookmark (1) where disposed and to cam-open the closed book (3) at such page — all without any damage at any time to the book (3) or any of its pages from the bookmark (1) and its described utilization.

Said bookmark (1) has a flat body (5) with horizontal edges (19) for such underlining and indicating function, a depending leg (13), angled 45 degrees relative to such body (5), with teeth (17), symmetrically arranged and disposed relative to such leg (13), that are angled inwardly and upwardly to maintain the bookmark (1) where disposed and inserted in the closed book (3) by means of such teeth (17) engaging the edge (21) of the book's pages and a tongue-like tab (7), defined by a surrounding slot (9), whose free end (15), angled 30 degrees relative to such tab (7), can be manipulated by slight twisting to cam-open the closed book (3).

5 Claims, 4 Drawing Figures

BOOKMARK

TECHNICAL FIELD

This invention relates to a bookmark for use with a book to underline and indicate a line or passage on a page selected by the reader; and to cam-open such book after same has been closed upon such bookmark disposed on such selected page.

BACKGROUND ART

The prior art, U.S. Pat. No. 779,100, discloses a clasp of spring-biased jaws that may be used to engage a book to thereby function as a bookmark; U.S. Pat. No. 1,123,008 discloses a book marker comprising two superposed plates, connected at one end, engaged by resilient members which tend to bring the free ends of such superposed plates together, and with such superposed plates being adapted to engage therebetween a book page; U.S. Pat. No. 1,862,573 discloses a device comprising spring fingers for engagement and retention with a book cover and with such device carrying a bookmark that is adapted to loosely fit on a book page; U.S. Pat. No. 2,207,657 discloses a U-shaped clip of superposed celluloid strips adhesively secured together with a pair of spaced, parallel-disposed, resilient wires therebetween and with such celluloid strips providing legs to frictionally grip the edge of cardboard or sheet therebetween; U.S. Pat. No. 2,609,629 discloses a badge, one embodiment of which has a body member whose one end portion has a heart-shaped tab formed by a corresponding slot and with such embodiment utilizable as a bookmark with such body member engaging one side of a page and with such tab engaging the other side of such page; U.S. Pat. No. 2,717,572 discloses a bookmark comprising a rectangular body whose one end portion has a tongue formed by a corresponding surrounding slot, with such body engaging one side of a page and with such tongue engaging the other side of such page; U.S. Pat. No. 3,158,131 discloses a bookmark comprising a resilient U-shaped clip for engagement with a book's cover, an elongated arm secured to such clip and extending therefrom, with a finger or tab depending from the free end of such elongated arm and with such finger or tab being adapted to lie between successive pages of such book.

DISCLOSURE OF INVENTION

In accordance with the present invention, a bookmark is provided, but is not countenanced in the prior art, in the form of an integral, one-piece body of rectangular configuration having a tongue-like tab defined by a surrounding slot and depending therefrom an articulated body having angled teeth formed therewith. The bookmark possesses the phenomena of its angled teeth functioning to retentively engage the edge of the book's pages whereat disposed to maintain such bookmark where same was so disposed and its tongue-like tab, upon appropriate manipulation thereof, to cam-open the book at the particular page in which such bookmark was inserted—moreover, in the utilization of the bookmark of this invention as intended, no damage whatsoever will result or will be visited upon any book or any of its pages.

In utilizing the bookmark of this invention with respect to a book, it should be appreciated that the bookmark is appropriately inserted on a particular page of the book and disposed such that one of such bookmark's horizontal edges will underline and indicate the line or passage on such page at which the reader desires to resume reading, and then the book is closed, with the angled teeth disposed to retentively engage the edge of the book's pages. The book is reopened to such particular page by the reader engaging the free end of the tab between his thumb and index finger and appropriately manipulating such free end of the tab to slightly twist same to therby cam-open the book at such particular page.

BRIEF DESCRIPTION OF DRAWINGS

The details of the invention will be described in connection with the accompanying drawing, in which.

BEST MODE FOR CARRYING OUT THE INVENTION

Figure 1:
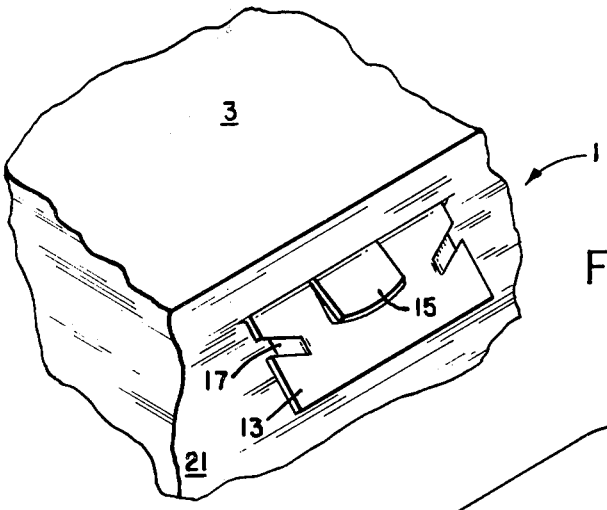
FIG. 1 is a view of the bookmark of this invention disposed and inserted in a book.

In FIG. 1 of the drawing, reference numeral 1 generally refers to the bookmark of this invention shown operatively and functionally disposed and inserted in a conventional book 3 having superposed pages bound together with said pages having outermost free margins constituting an edge.

Figure 2:
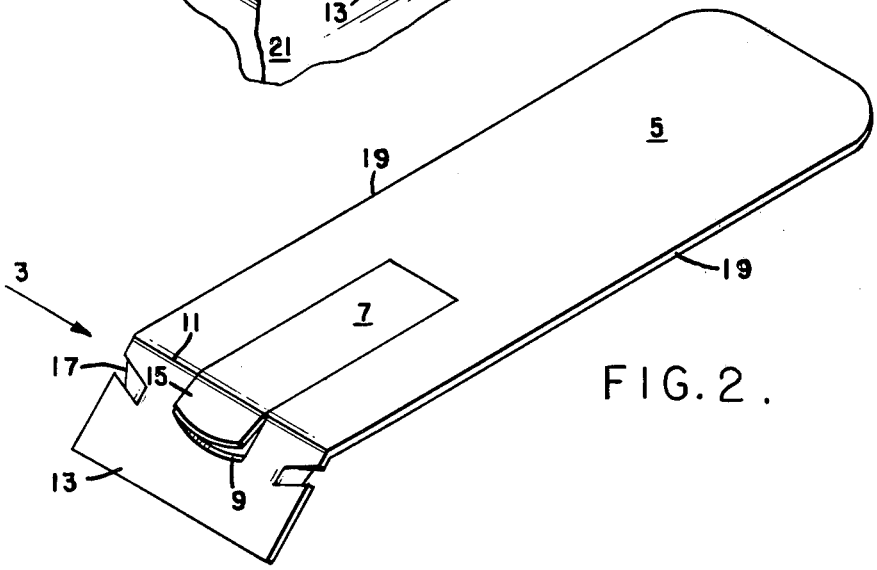
FIG. 2 is a perspective view of the invention.
Figure 3:
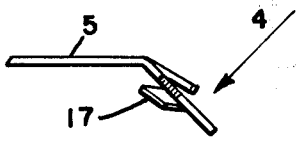
FIG. 3 is a view in the direction of the arrow "3" in FIG. 2.
Figure 4:
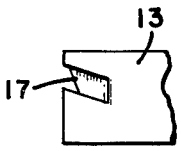
FIG. 4 is a view in the direction of the arrow "4" in FIG. 3.

Shown more discernably in FIG. 2, bookmark 1, of plastic or other suitable material, is of integral, one-piece construction and has a flat body 5 of rectangular peripheral shape that is square. Body 5 has a tongue-like tab 7 defined by a surrounding slot 9, as shown. Both body 5 and tab 7 are appropriately bent or creased, as indicated by reference numeral 11 applied thereto, to form, with respect to body 5, an articulated leg 13 depending from the plane of body 5 at an angle of approximately 45 degrees and to form, with respect to tab 7, an articulated free end 15 depending from tab 7 at an angle of approximately 30 degrees. Formed in depending leg 13, and symmetrically arranged and disposed, as shown, are teeth 17 that are angled both inwardly and upwardly from leg 13. Body 5 has horizontal edges 19, one of which functions to underline and indicate the particular line or passage on a particular page of the book marked and selected by the reader at which he desires to resume reading.

In utilizing the bookmark 1 of this invention, the reader appropriately disposes such bookmark 1 on a particular page of book 3 such that one of the horizontal edges 19 will underline the particular line or passage thereon that the reader wants underlined, such that the crease 11 engages the edge 21 of book 3, whereby the angled teeth 17 engage the edge 21 of book 3, as shown, and then the reader closes book 3 with such bookmark 1 thusly disposed and inserted in book 3. To reopen book 3, the reader appropriately engages the free end 15 of tab 7 between his thumb and index finger and appropriately manipulates such free end 15 of tab 7 to slightly twist tab 7 to thereby cam-open the book 3 at such particular page.

It should be discerned and appreciated that the described angular disposition of leg 13 relative to its flat body 5 permits the bookmark 1 of this invention to be inserted on the latter pages and even the last page of book 3 because at such particular insertions the underside of leg 13 will non-interferingly ride upon and over the bottom cover of book 3.

Furthermore, regardless of where bookmark 1 is inserted within book 3, book 3 can be fully shelved inwardly so that the covers of book 3 engage the facing rear portion of any shelf or book case. When book 3 is thusly shelved fully inwardly, both leg 13 and the free end 15 of tab 7 bend downwardly, as viewed in FIG. 1, along their common crease 11 and without any damage whatsoever to the book 3 within which such bookmark 1 is inserted or without any damage whatsoever to any adjacent book in such shelf or bookcase.

INDUSTRIAL APPLICABILITY

As should now be obvious from the description and nature of bookmark 1 of this invention, same can be utilized and exploited by all book readers for the purposes set forth hereinbefore, to wit: to simply, easily and quickly locate and underline a particular line or passage on a page, and to thereafter simply, easily and quickly cam-open such book 3 to such selected page—all without any damage to such book or any of its pages from such utilization of the bookmark 1 of this invention.

I claim:

1. A bookmark for use with a book whose pages form an edge to underline and indicate a line or passage on a page selected by the reader; said bookmark being of integral, one-piece construction and comprising a flat body having a leg and tab; said flat body underlining and indicating said selected line or passage when said bookmark is disposed and inserted in said book, said tab being of tongue-like configuration and being defined by a surrounding slot, said leg and tab having a common bend or crease at which said leg depends from the plane of said flat body at an acute angle and from which said tab has an articulated free end depending from the plane of said flat body at a lesser angle, said depending leg having teeth for retentively engaging the edge of said book's pages to maintain said bookmark in the position where same has been disposed and said book has been closed, and said tab being manipulative by the reader to cam-open said closed book to the particular page on which said bookmark had been disposed and inserted by the reader's appropiately engaging said articulated free end of said tab between his thumb and index finger and twisting same to effect such cam-opening action.

2. The bookmark of claim 1 wherein said leg depends from said plane of said flat body at an angle of approximately 45 degrees.

3. The bookmark of claim 1 wherein said articulated free end of said tab depends from the plane of said flat body at an angle of approximately 30 degrees.

4. The bookmark of claim 1 wherein said teeth are symmetrically arranged and disposed relative to their said depending leg, and are angled inwardly and upwardly.

5. The bookmark of claim 1 wherein said flat body has horizontal edges for said underlining and indicating said selected line or passage, wherein said leg and said articulated free end of said tab depend from the plane of said flat body at angles of approximately 45 and 30 degrees, respectively, and wherein said teeth are symmetrically arranged and disposed relative to their said depending leg, and are angled inwardly and upwardly.

* * * * *